US006354434B1

(12) United States Patent
Stamer

(10) Patent No.: US 6,354,434 B1
(45) Date of Patent: Mar. 12, 2002

(54) FOLDED PAPER BOARD CD CARRIER AND METHOD OF MAKING THE SAME

(75) Inventor: Laura A. Stamer, Chicago, IL (US)

(73) Assignee: R. R. Donnelley & Sons, Chicago, IL (US)

( * ) Notice: Subject to any disclaimer, the term of this patent is extended or adjusted under 35 U.S.C. 154(b) by 0 days.

(21) Appl. No.: 09/518,774

(22) Filed: Mar. 3, 2000

(51) Int. Cl.[7] ..... B65D 85/57
(52) U.S. Cl. ..... 206/308.1; 53/456; 493/162
(58) Field of Search ..... 206/303, 307, 206/308.1, 308.3, 310, 312, 493; 53/456; 493/162

(56) References Cited

U.S. PATENT DOCUMENTS

| | | | | | |
|---|---|---|---|---|---|
| 1,554,995 | A | * | 9/1925 | Fetters | 206/310 |
| 2,600,023 | A | * | 6/1952 | Rice | 206/310 |
| 2,615,564 | A | * | 10/1952 | Post | 206/493 |
| 4,049,120 | A | * | 9/1977 | Bower | 206/303 |
| 4,062,447 | A | * | 12/1977 | Gardner | 206/493 |
| 4,159,768 | A | * | 7/1979 | Manis et al. | 206/493 |
| 4,709,812 | A | | 12/1987 | Kosterka | |
| 5,307,927 | A | | 5/1994 | Curtis et al. | |
| 5,662,218 | A | | 9/1997 | Ladwig | |
| 5,749,463 | A | * | 5/1998 | Collins | 206/308.1 |
| 5,887,714 | A | * | 3/1999 | Yeo | 206/308.1 |
| 5,971,157 | A | * | 10/1999 | Howell et al. | 206/308.1 |
| 5,988,375 | A | * | 11/1999 | Chang | 206/308.1 |

* cited by examiner

*Primary Examiner*—Jim Foster
(74) *Attorney, Agent, or Firm*—Marshall, Gerstein, & Borun

(57) ABSTRACT

A device for carrying a compact disc having a central aperture and a method of forming the same are provided. The device comprises a blank formed from a single piece of paper board stock, with the blank including a generally rectangular portion having a plurality of fold lines dividing the blank into a plurality of sections. At least one of the sections is foldable along a fold line to a closed position in which the one section forms with an adjacent section an enclosure. A hub is formed in the one section, with the hub including a pair of members. Each member includes an outer portion sized to extend through the compact disc aperture. Each member is shiftable between an unfolded position, in which the member is disposed in the plane of the one section, to a first folded position, in which the member outer portion is folded along a first fold line and is positioned to extend through the compact disc aperture. Each member is further shiftable to a second folded position, in which the outer portion is foldable along a second fold line, with the second fold line being spaced away from the first fold line by a distance generally equivalent to the thickness of the compact disc. Thus, upon shifting the members to the first folded position a compact disc may be placed adjacent the one section, and upon shifting the members to the second folded position and folding the sections to the closed position a compact disc may be secured in the enclosure.

19 Claims, 13 Drawing Sheets

FOLDED PAPER BOARD CD CARRIER AND METHOD OF MAKING THE SAME

FIELD OF THE INVENTION

The present invention relates to a folded paper board device for holding articles such as compact discs.

BACKGROUND OF THE INVENTION

Compact discs, which are commonly referred to as "CD's" are generally well known in the art. Standard CD's having a nominal diameter of about four and three quarters (4¾) inches are commonly used to store prerecorded music, prerecorded video, and data for reading by a computer. Due to technical advances, a CD can store an incredible amount of data and thus CD's are greatly preferred over other storage mediums, such as magnetic recording tape.

It is well known that CD's are commonly employed as a convenient medium for storing computer software, and, owing to the capacity of CD's to store such great amounts of data, CD's are commonly employed to store all of the data necessary for a wide variety of applications. For example, CD's are often used to store data for entire sets of encyclopedias, dictionaries, legal treatises, legal reporters, maps, games, etc., not to mention to store music for CD players and video/audio for DVD players. Many other applications are also well known.

Owing to the advances in technology that have given rise to the proliferation of CD's as a storage medium, the purveyors of the above-described items, such as book and magazine publishers, music companies, video companies, software companies, and internet-related service providers and search engines now frequently mail their goods on CD's directly to consumers. Accordingly, there is a continuing need for cost-effective yet secure packaging in which to mail CD's to the end user.

SUMMARY OF THE INVENTION

In accordance with a first aspect of the invention, a device for carrying a compact disc having a central aperture comprises a blank formed from a single piece of paper board stock, with the blank including a generally rectangular portion having a plurality of fold lines dividing the blank into a plurality of sections. At least one of the sections is foldable along a fold line to a closed position in which the one section forms with an adjacent section an enclosure. A hub formed in the one section, with the hub including a pair of members. Each member includes an outer portion sized to extend through the compact disc aperture, and each member is shiftable between an unfolded position in which the member is disposed in the plane of the one section, to a first folded position in which the member outer portion is folded along a first fold line and positioned to extend through the compact disc aperture. Each member is further shiftable to a second folded position in which the outer portion is foldable along a second fold line, with the second fold line being spaced away from the first fold line by a distance generally equivalent to the thickness of the compact disc. Thus, upon shifting the members to the first folded position a compact disc may be placed adjacent the one section, and upon shifting the members to the second folded position and folding the sections to the closed position a compact disc may be secured in the enclosure.

In preferred embodiment, each member may be sized to engage a portion of the compact disc aperture so that second fold line is formed in part upon folding each member from the first folded position toward the second folded position after placement of the compact disc adjacent the one section. The compact disc aperture may a circular inner edge, and each member may include a root section sized to engage the inner edge. The compact disc aperture may measure about 1.5 centimeters in diameter, and the root section of each member may measure about 1.1 centimeters. Alternatively, the root section of each member may measure about seventy five percent of the diameter of the aperture in the compact disc.

Preferably, each of the members may be defined in part by one or more score lines formed in the one section, with the one or more score lines generally circumscribing the outer portion of each member. Each score line will define a frangible connection. Preferably, each member includes a tip, and the one section may include an aperture formed adjacent each tip, with the aperture being sized to permit grasping of the member tip by a user.

The device may further include a protruding tab formed on one of the sections. Another one of the sections may include a slot positioned for engagement by the tab when the device is folded, thereby providing at least one manner by which to secure the device in a folded position. Other means carried by at least one of the sections may be provided for maintaining the sections in the closed position.

In accordance with a second aspect of the invention, a hub device is provided for securing a compact disc having a central aperture to a generally planar surface, with the hub device comprising a paperboard section having a plurality of score lines formed therein. The score lines define a pair of members and a generally planar base, with each of the members including an outer portion sized to extend through the compact disc aperture. Each of the members is shiftable between an unfolded position, in which each member is disposed in the plane of the base, to a first deflected position in which the outer portion of each of the members is deflected along a first line and positioned to extend through the compact disc aperture. Each of the members further is shiftable to a second deflected position, in which the outer portion is deflected along a second line, with the second line being spaced away from the first line by a distance generally equivalent to the thickness of the compact disc, with members being adapted to secure the compact disc against movement when the members are in the second deflected position. Means, carried by the base, are provided for securing the section to the planar surface.

In accordance with another aspect of the invention, a hub device is provided for securing a compact disc having a central aperture to a generally planar surface. The hub device comprises a paperboard section having a plurality of score lines formed therein, with the score lines defining in part a pair of members and a generally planar base. Each of the members includes an outer portion sized to extend through the compact disc aperture. Each member further is foldable between an unfolded position, in which the member is disposed in the plane of the base, to a first folded position, in which the member outer portion is deflected along a first fold line and is positioned to extend through the compact disc aperture, and a second folded position, in which the outer portion is folded along a second fold line. The second fold line is spaced away from the first line by a distance generally equivalent to the thickness of the compact disc. With a compact disc placed adjacent the section, the members are adapted to secure the compact disc against movement when the members are shifted to the second deflected position. Means, carried by the base, are provided for securing the section to the planar surface.

In accordance with a further aspect of the invention, a device is provided for carrying a plurality of compact discs, with each of the compact discs having a central aperture. The device comprises a generally rectangular blank formed from a single piece of paper board stock, with the blank including a plurality of fold lines dividing the blank into a first set of sections and a second set of sections. Each of the sections in the first set is foldable along at least one fold line to a folded position such that, when the sections of the first set are in the folded position, the at least one section of the first set and the at least one section of the second set form an enclosure or space sized to receive therein one of the compact discs. A hub is formed in each of the sections of the first set, with each hub including a pair of members. Each of the members includes an outer portion sized to extend through the compact disc aperture, and each of the members is shiftable between an unfolded position, in which the member is disposed in the plane of its corresponding section, to a first folded position, in which the member outer portion is folded along a first fold line and positioned to extend through the compact disc aperture, and further to a second folded position, in which the member outer portion is folded along a second fold line to secure one of the compact discs. The second fold line may be spaced away from the first fold line by a distance generally equivalent to the thickness of one of the compact discs. Thus, upon shifting the members to the first folded position, a compact disc may be placed adjacent each of the sections of the first set. Further, upon shifting the members to the second folded position, the compact disc may be secured to its corresponding section. Then, upon folding the sections to the folded position the compact discs may be secured in their respective enclosures.

In accordance with a still further aspect of the invention, a method of forming a compact disc carrier comprises the steps of forming a paperboard blank having a plurality of fold lines dividing the blank into a plurality of sections, forming in at least one of the sections a hub, with the hub having a pair of deflectable members foldable to a first position, in which the members are positioned to receive the compact disc, and a second position, in which the members are positioned to retain the compact disc adjacent the one section. The method includes the steps of forming an enclosure by folding the one section along a fold line to a folded position disposed parallel to an adjacent section, and then securing the sections in the folded position.

DETAILED DESCRIPTION OF THE PREFERRED EMBODIMENTS

The embodiments described herein are not intended to be exhaustive or to limit the scope of the invention to the precise forms disclosed. Rather, the following embodiments have been chosen and described in order to best illustrate the principles of the invention and to enable others skilled in the art to follow the teachings thereof.

Figure 1:
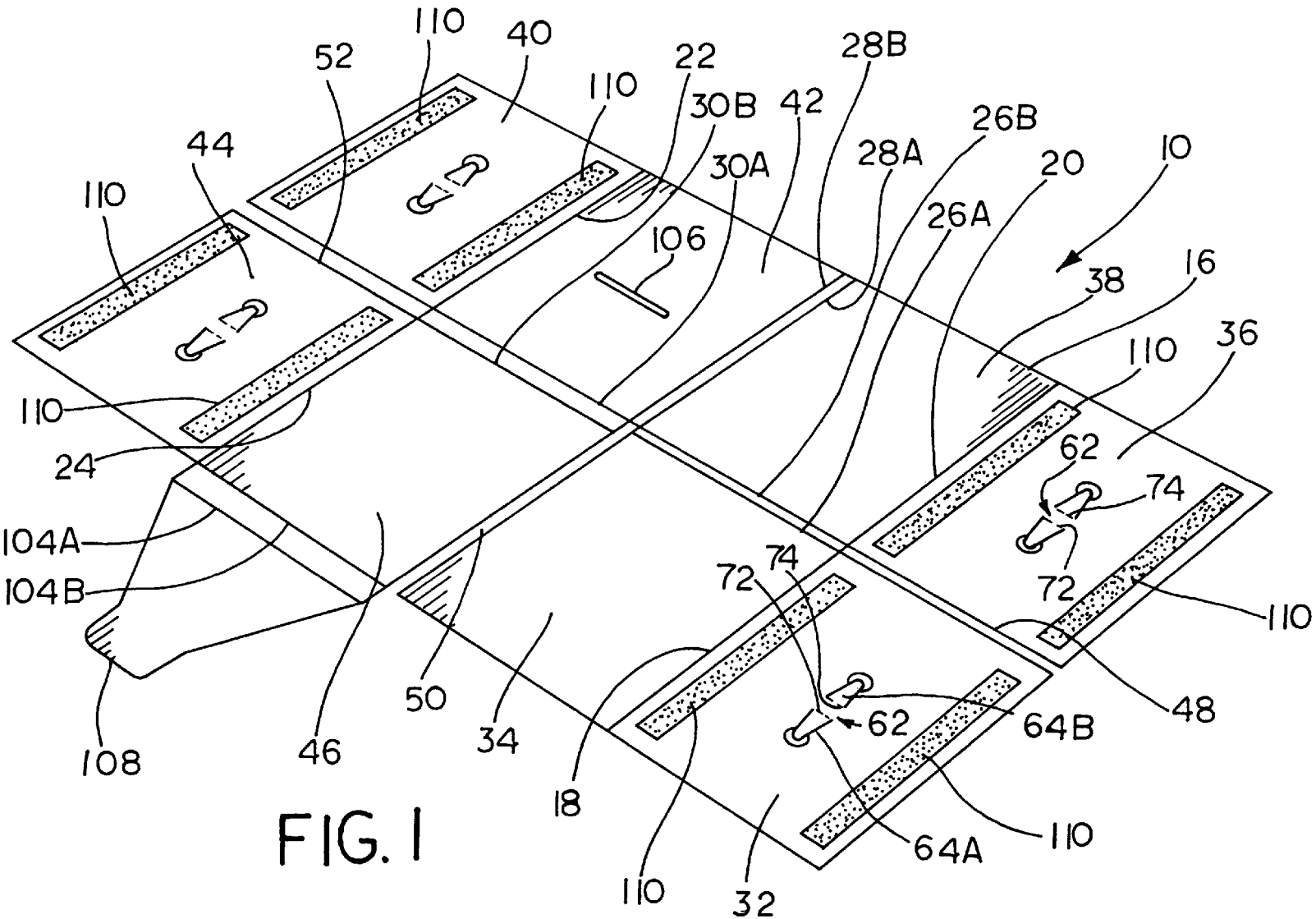
FIG. 1 is a perspective view of a folded paperboard CD carrier constructed in accordance with the teachings of the present invention and shown in its flat or unfolded state.

Referring now to FIGS. 1–7 of the drawings, a CD carrier constructed in accordance with the teachings of a first preferred embodiment of the present invention is generally referred to by the reference numeral 10. The device 10 may be used to carry a compact disc 12 (hereinafter "CD") of the type shown in each of FIGS. 2–5 and which is commonly used in the art to store machine readable data. It will be noted that the CD 12 will typically have a central aperture 14 having a nominal diameter of about 1.5 centimeters. The CD carrier 10 is constructed of a paper or paperboard blank 16. The blank 16 is preferably formed from a single piece of stock, and still preferably may be constructed of eighteen (18) point stock. The blank 16, when positioned flat or fully unfolded as shown in FIG. 1, may be generally rectangular in shape. The blank 16 includes a plurality of fold lines 18, 20, 22, 24, 26A, 26B, 28A, 28B, 30A, and 30B. The afore-mentioned fold lines divide the blank 16 into a plurality of panels 32, 34, 36, 38, 40, 42, 44 and 46. Each of the panels 32, 36, 40 and 44 are foldable along their respective fold lines 18, 20, 22 and 24.

The blank 16 will preferably include a set of cutouts 48, 50 and 52. The cutout 48 will permit the panels 32, 36 to fold along their corresponding fold lines 18, 20, respectively, independently of each other. Similarly, the cutout 50 will permit the panel 34 (and the panel 32 attached thereto) to fold along its corresponding fold lines 26A and 26B independently of the nearby panel 46. Finally, the cutout 52 will permit the panels 40 and 44 to fold along their corresponding fold lines 22, 24, respectively, independently of each other.

Figure 2:
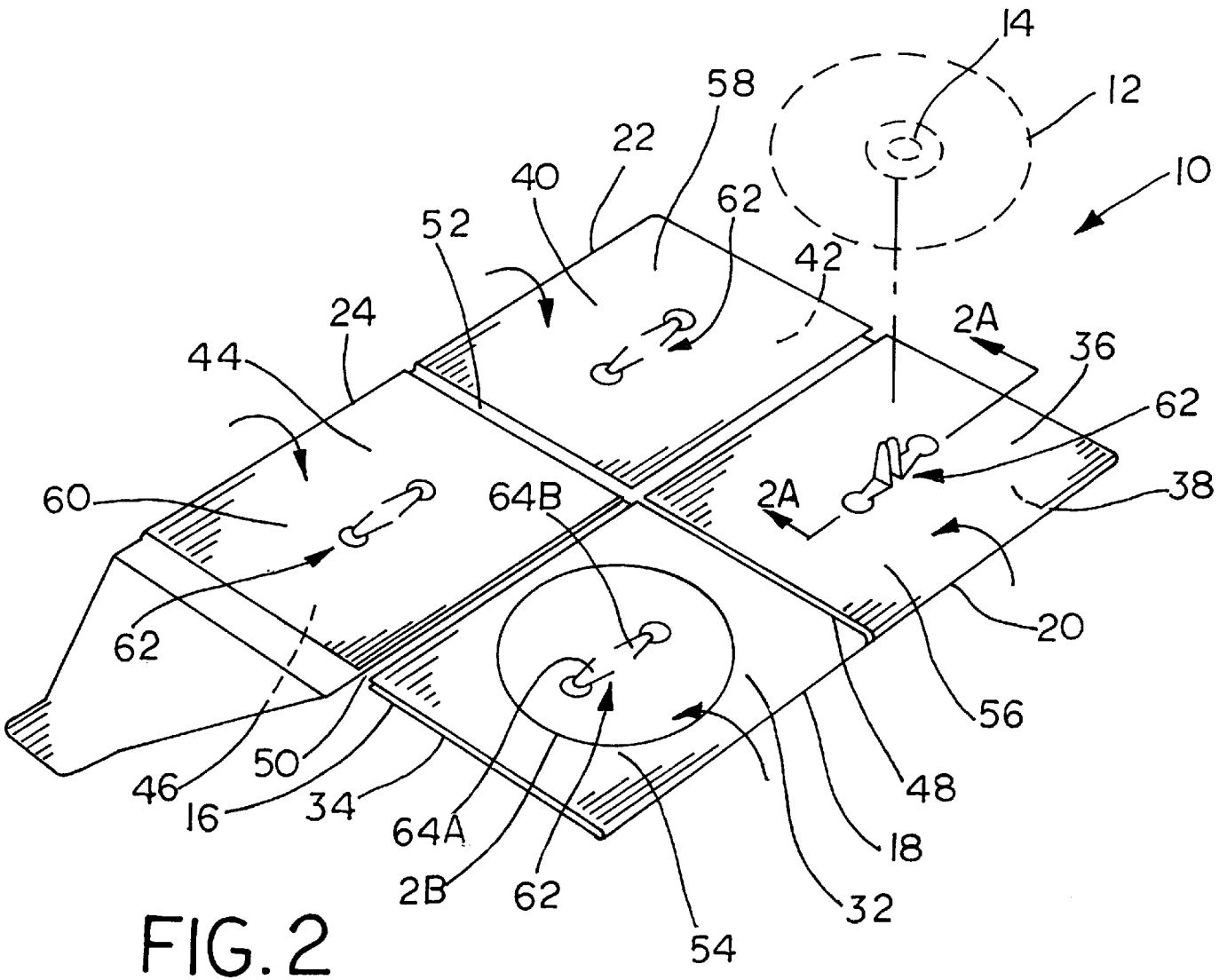
FIG. 2 is a perspective view similar to FIG. 1 but illustrating the device in one possible partially folded state.

Referring now to FIG. 2, when the panel 32 is folded along its corresponding fold line 18, the panels 32 and 34 are positioned together to form a section 54. In a similar manner, the panel 36 may be folded along the fold line 20 to form with the panel 38 a section 56. Similarly, the panels 40 and 44 may be folded along their fold lines 22, 24, respectively, to form with the panels 42 and 46 the sections 58 and 60, respectively.

As shown in each of FIGS. 1–6, a hub 62 is defined in each of the panels 32, 36, 40 and 44. The hub 62 in each panel is preferably substantially identical to the hub 62 in the remaining panels. Thus, only the structure and operation of a single such hub 62 will be described herein in detail. The hub 62 includes a pair of arms or members 64A and 64B. The member 64A includes an outer portion 66A terminating in a tip 68A. The member 64B includes an outer portion 66B terminating in a tip 68B. A portion of the surrounding panel, in the illustrated case the panel 32, defines a base 70. The members 64A and 64B are each deflectable or foldable along a fold line 72, 74, respectively, from the relatively flat position illustrated in FIGS. 2 and 2B, toward the upright, deflected or first folded position of FIG. 2A. It will be appreciated that the tips 68A and 68B, as well as most or all of the outer portions 66A and 66B, are sized to fit through the aperture 14 of the CD 12.

Figure 2B:
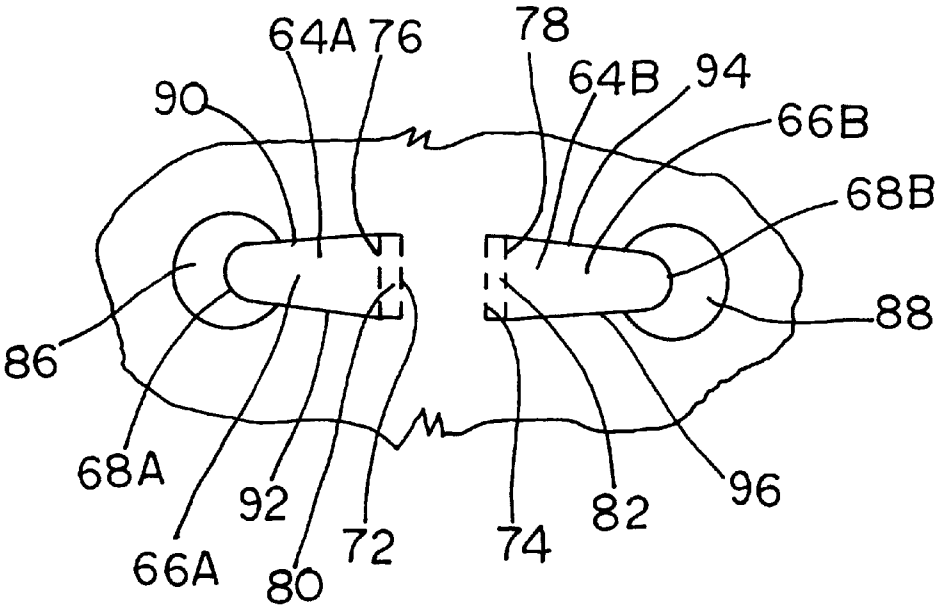
FIG. 2B is an enlarged fragmentary plan view taken about the circumscribed portion of FIG. 2.
Figure 2A:
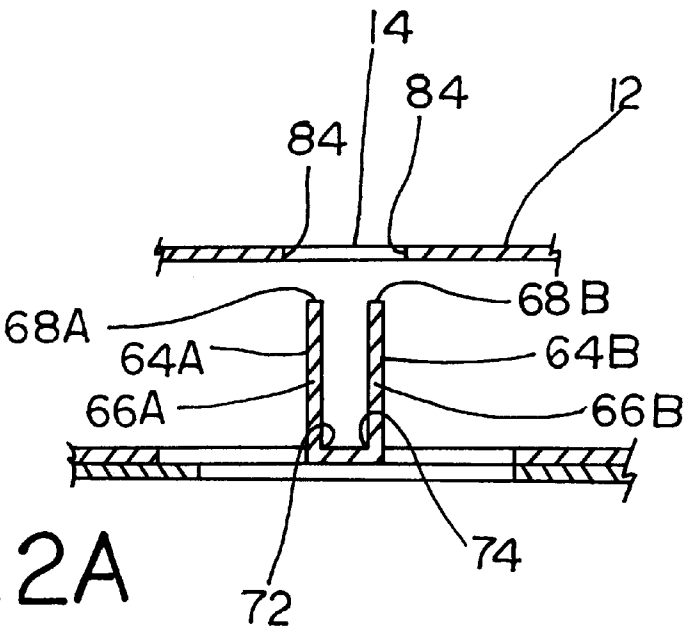
FIG. 2A is an enlarged fragmentary cross-sectional view taken along line 2A—2A of FIG. 2 and illustrating one possible version of the retaining members folded upward to a position in which a CD may be placed adjacent the corresponding section.
Figures 3, 3A:
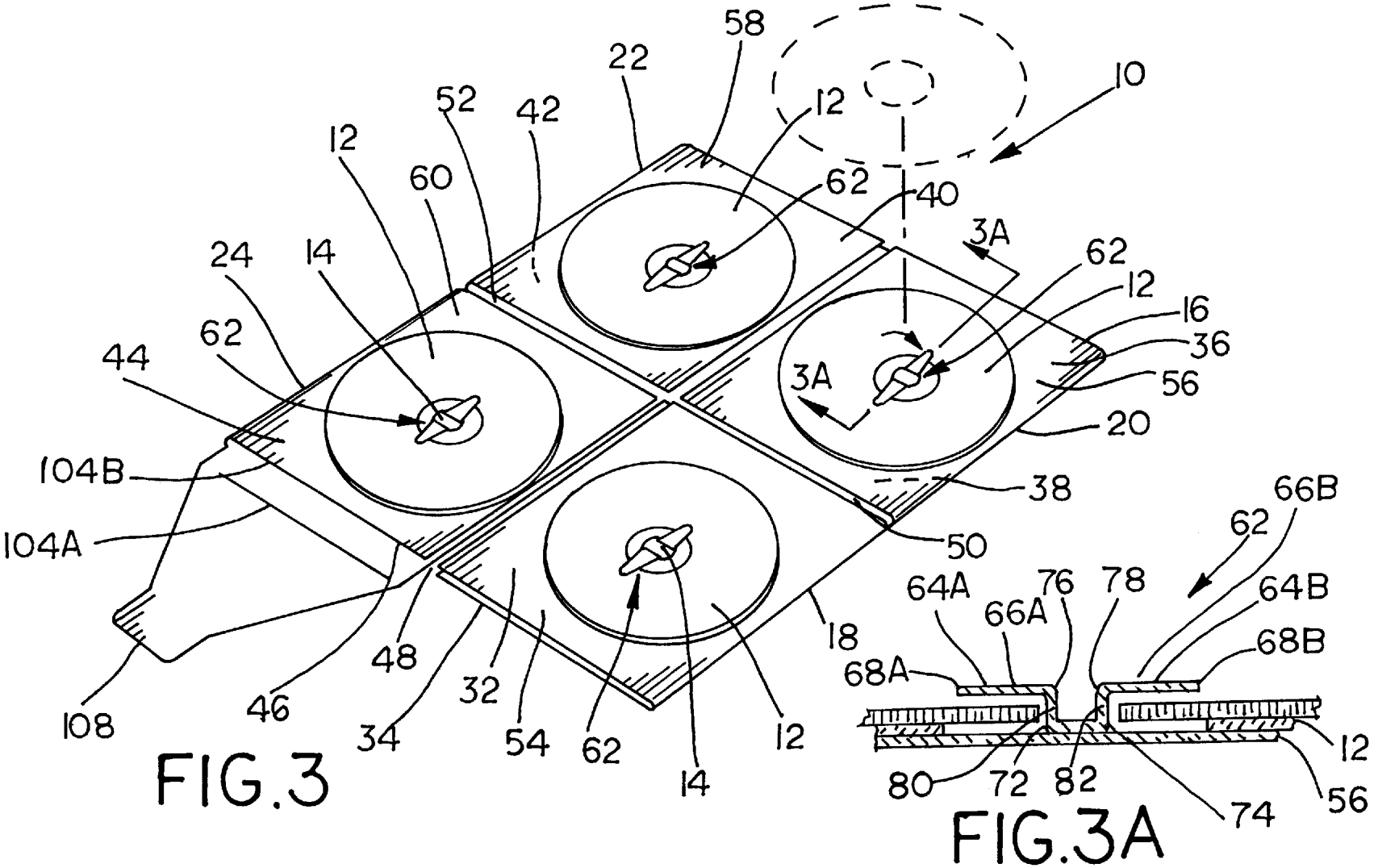
FIG. 3 is a perspective view similar to FIG. 2 but showing four CD's secured to the device.
FIG. 3A is an enlarged fragmentary cross-sectional view taken along line 3A—3A of FIG. 3 and illustrating one possible version of the retaining members folded downward toward a position in which a CD may be retained adjacent the corresponding section.

Referring now to FIGS. 2A and 3A, subsequent to the placement of a CD 12 adjacent one of the panels such that the members 64A and 64B extend through the aperture 14 thereof, the members 64A and 64B are foldable to the second deflected or folded position of FIG. 3A along fold lines 76, 78, respectively.

Referring again to FIG. 2A, the fold line 72 is spaced away from the fold line 76 a distance approximately equal to the thickness of the CD 12. Similarly, the fold line 78 is spaced away from the fold line 74 a distance approximately equal to the thickness of the CD 12. The region in the vicinity of the of the fold lines 72 and 76 generally defines a root section 80 of the member 64A, while the region in the vicinity of the fold lines 74 and 78 generally defines a root section 82 of the member 64B. The root sections 80, 82 will preferably be sized so as to engage an inner edge 84 of the aperture 14 of the CD 12 when the CD 12 is in the position of FIG. 3A.

It will be noted that the diameter of the aperture 14 in the CD measures approximately 1.5 centimeters. Accordingly, favorable results have been obtained when the root sections 80, 82 measure approximately 1.1 centimeters measured in the direction parallel to the fold lines 72, 74, 76 and 78. It will further be noted that the root sections 80, 82 will measure in the direction indicated about 75% of the diameter of the aperture 14.

A cutout 86 is formed adjacent the member 64A, while a cutout 88 is formed adjacent the member 66A. The member 64A is defined in part along a boundary indicated by the lines 88, 90, which lines 88, 90 are preferably score lines defining frangible connections. The member 64B is defined in part along a boundary indicated by the lines 92, 94, which lines 92, 94 are preferably score lines defining frangible connections. The cutouts 86, 88 need not be provided, but will better enable a user (not shown) to grasp the members 64B and 64B in order to manipulate the members as described above.

Figure 4:
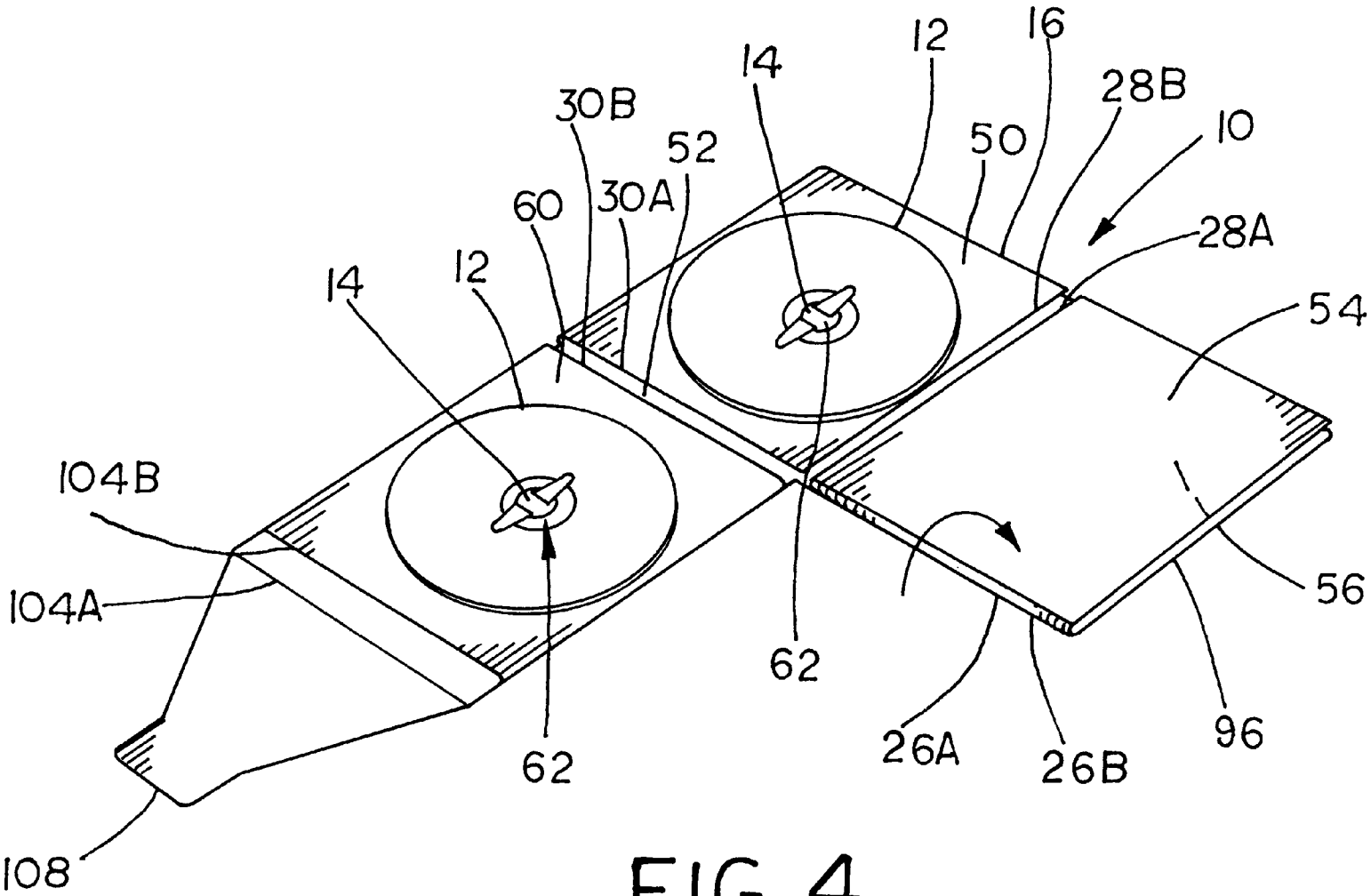
FIGS. 4 through 7 are perspective views illustrating one possible sequence for folding the sections of the device so as to create at least one version of a CD carrier or mailer in accordance with the teachings of the present invention.
Figure 5:
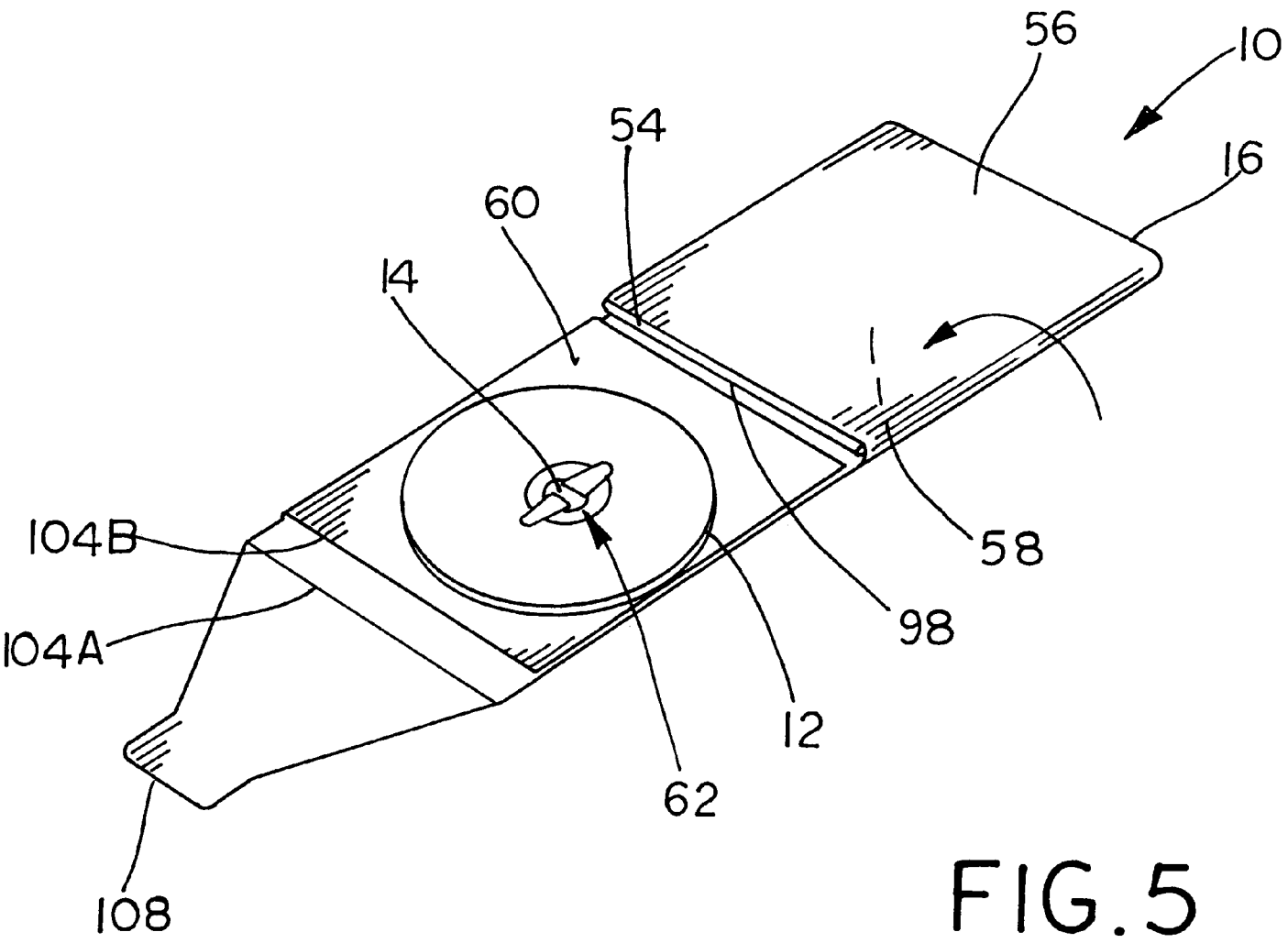
Figure 7:
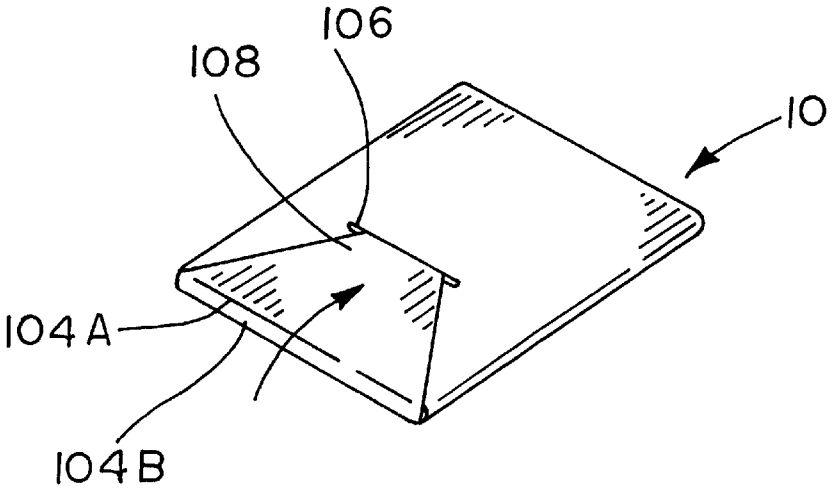
Figure 6:
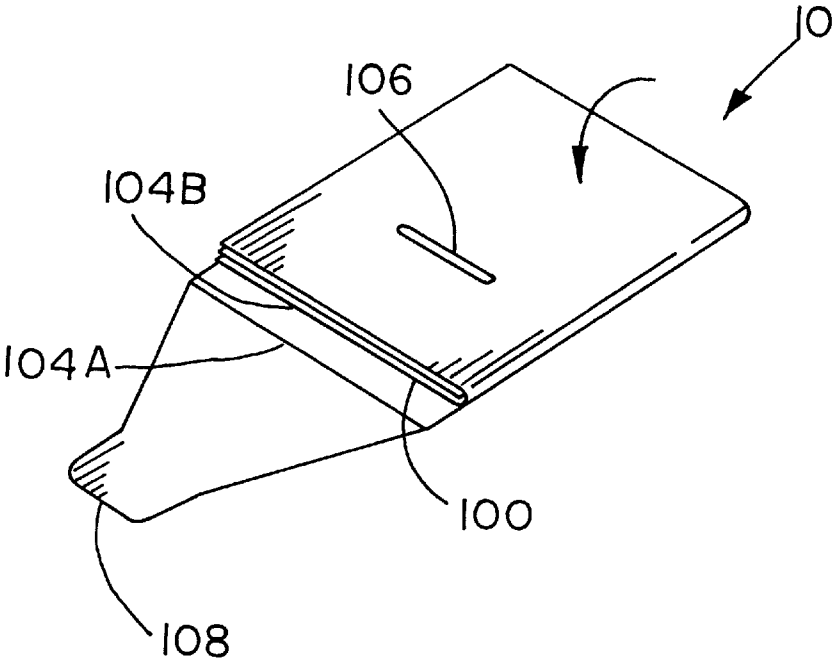

It will be noted that, upon folding the section 54 from the position of FIG. 3 to the position of FIG. 4 adjacent the section 56, that an enclosure 96 will be defined in between the adjacent sections 54 and 56. When the sections 54/56 are folded form the position of FIG. 4 toward the position of FIG. 5, an enclosure 98 will be formed between the sections 54/56 and the section 58. Finally, when the sections 54/56/58 are folded from the position of FIG. 5 toward the position of FIG. 6, and enclosure 100 will be formed between the sections 54/56/58 and the section 60. A tab 102 may be provided protruding from at least one of the panels, in this case the panel 46. The tab 102 may be folded along at least one fold line to secure the CD carrier 10 in the position of FIG. 7. In this case a pair of spaced fold lines 104A and 104B are provided in order to prevent binding, bunching or buckling. A slot 106 is provided in the panel 42, which slot 106 will receive an end 108 of the tab 102. Other means may be provided for securing the CD carrier 10 in the position of FIG. 7 as would be known.

Referring again to FIGS. 1 and 2, it will be noted that one or more sets of adhesives strips 110 may be provided (FIG. 1) in order to secure the panels in the position of FIG. 2. The adhesive strips 110 may be peel-off strips as would be known, and may be applied using known techniques. Other conventional gluing or attachment methods may be used. Alternatively, the strips 110 may be dispensed with entirely.

It will be appreciated that the CD carrier 10 preferably is formed from a single paper blank 16. The cutouts 48, 50 and 52, as well as the cutouts 86, 88 and the lines 88, 90, 92 and 94, are all preferably stamped or otherwise cut from the blank 12 using well accepted and conventional practices as would be known in the printing, binding, and packaging arts. For purposes of efficiency in forming the CD carrier 10, each of the fold lines 18, 20, 22, 24, 26A, 26B, 28A, 28B 30A, and 30B, along with the fold lines 72, 74, 76, and 78, are preferably machine formed using well known and commercially available folding machines and techniques. Alternatively, each of the above-described fold lines may be formed using a series of aligned perforations, or by using other well known methods which may be well suited to forming a foldable line or hinge.

Alternatively, the fold lines 76 and 78 may be formed or defined upon the act of folding the members 64A and 64B form the first folded position of FIG. 2A toward the second folded position of FIG. 3A, in which case the need for providing perforations along the fold lines 76, 78 may be dispensed with.

It will also be noted that the gaps afforded by the cutouts 48, 50, 52 may or may not be equal. Rather, the gap width may increase gradually from the cutout 48 to the cutout 52 in order to accommodate the increasing bulk of the CD's being stored therein.

In operation, the blank 16 may be prepared using the above-described conventional methods. The user may then fold the panels 32, 36, 40 and 44 along their respective fold lines 18, 20, 22 and 24, such that the CD carrier is changed form the state shown in FIG. 1 to the state shown in FIG. 2. Should the peel-off strips 110 be used, the strips would of course be prepared prior to folding the mentioned panels. The CD carrier 10 now has four sections 54, 56, 58 and 60, with each section including a hub 62.

One or more of the hubs 62 are then prepared to receive a CD 12 by moving or shifting the members 64A and 64B from the position of FIGS. 1 and 2B toward the position of FIG. 2A along the fold lines 72 and 74. A CD 12 may then be placed adjacent the one section by inserting the members 64A and 64B through the aperture 14 of the CD 12. The members 64A and 64B are then folded along the fold lines 76, 78, respectively, toward the position of FIG. 3A. The CD is now secured to the section. The process may be repeated for each of the sections.

Figure 8:
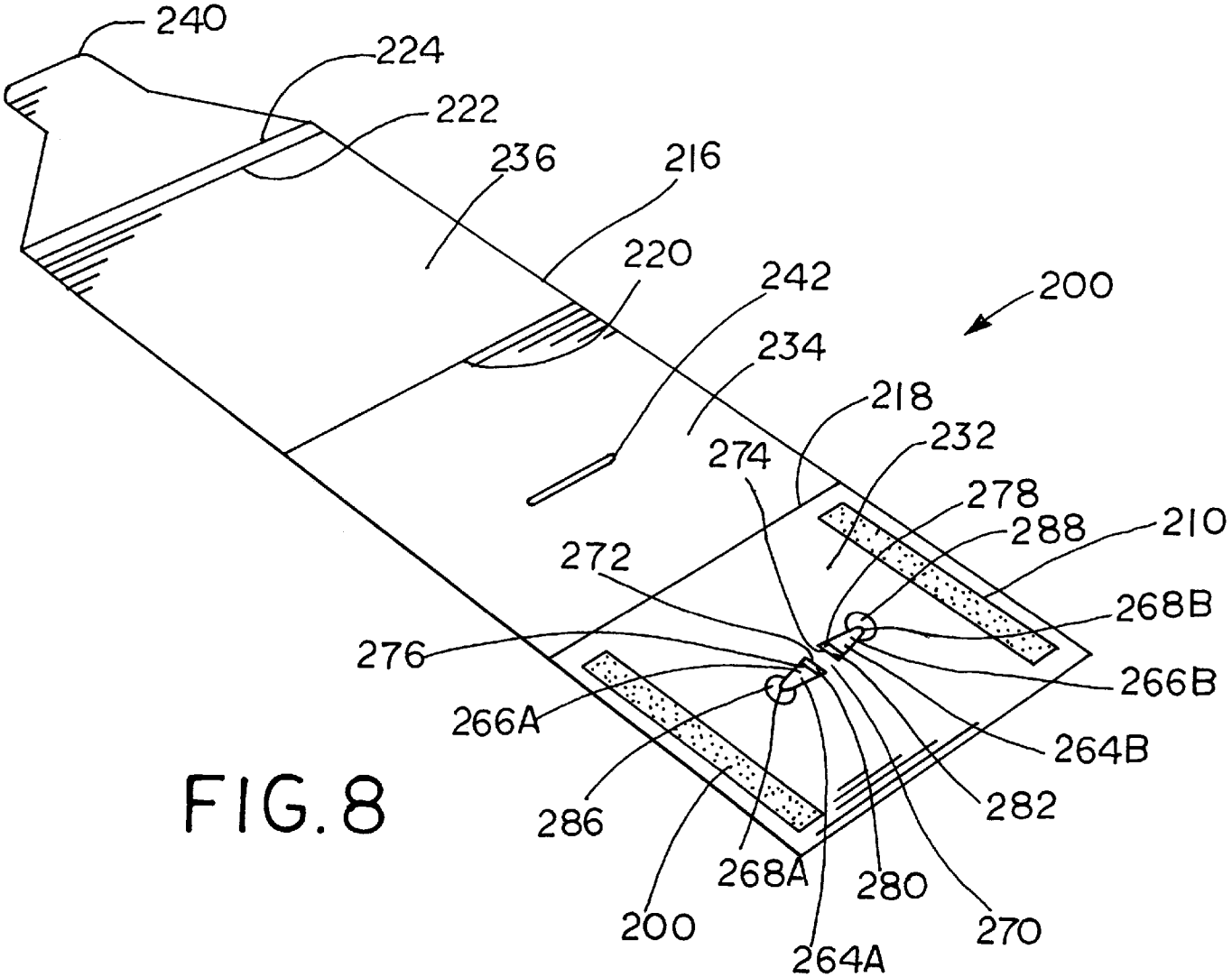
FIG. 8 is a perspective view of a folded paperboard CD carrier constructed in accordance with the teachings of a second embodiment of the present invention and shown in its flat or unfolded state.

Once the desired number of CD's 12 are attached, the CD carrier may be folded following the progression illustrated in FIGS. 2–6, and may be secured closed as shown in FIG. 8 using the tab 108 in the slot 106.

Referring now to FIGS. 8–12 of the drawings, a CD carrier constructed in accordance with the teachings of a second preferred embodiment of the present invention is generally referred to by the reference numeral 200. The CD carrier 200 may be used to carry a compact disc 12 (hereinafter "CD") of the type described above in conjunction with the embodiment of FIGS. 1–7. The CD carrier 200 is constructed of a paper or paperboard blank 216. The blank 216 is preferably formed from a single piece of stock. The blank 216, when positioned flat or fully unfolded as shown in FIG. 8, may be generally rectangular in shape. The blank 216 includes a plurality of fold lines 218, 220, 222, and 224. The afore-mentioned fold lines divide the blank 216 into a plurality of panels 232, 234, 236, and 238. A tab 240 is defined adjacent the fold line 224, while a slot 242 is defined in one of the panels, in this case in the panel 234.

Figure 9:
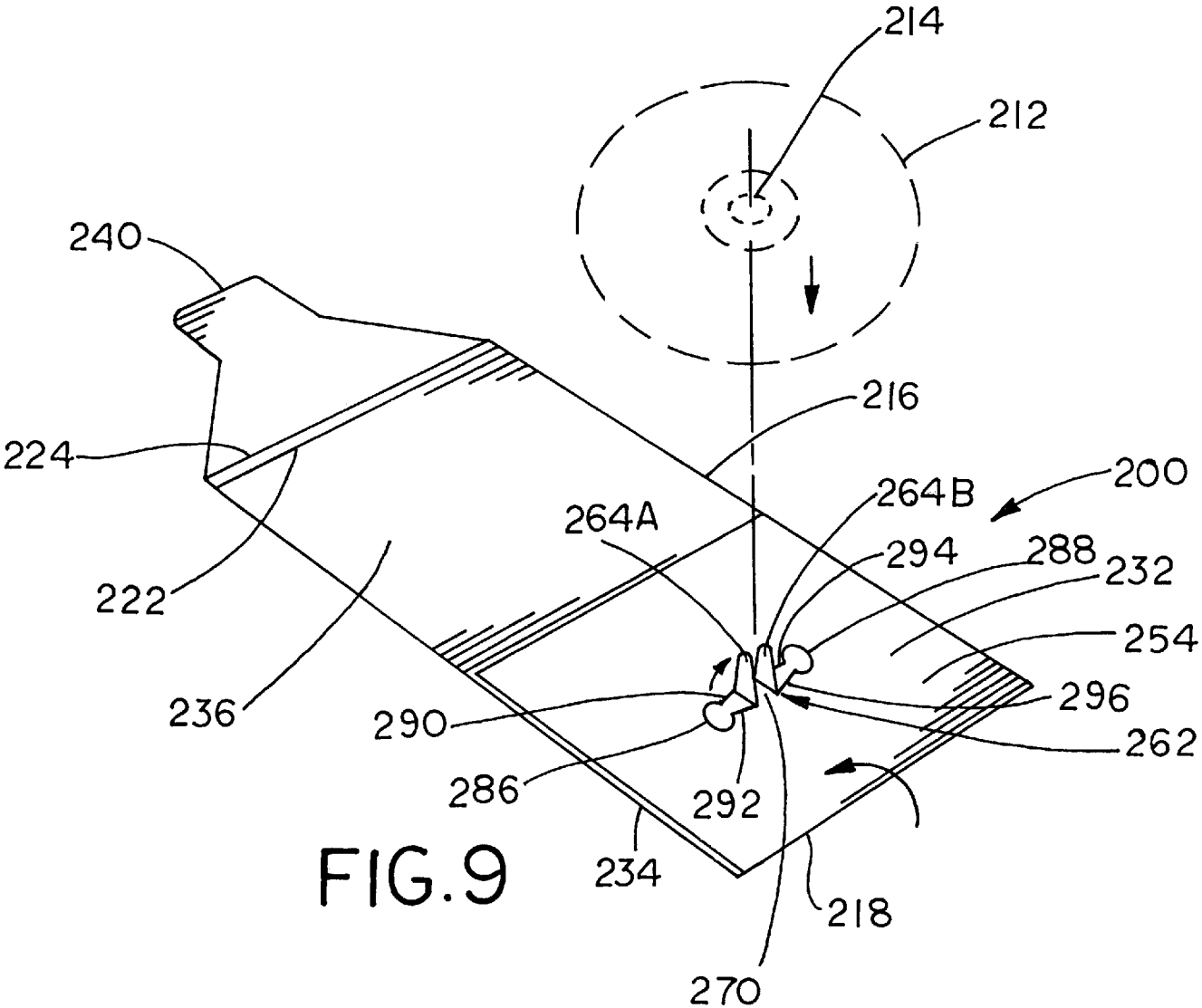
FIG. 9 is a perspective view similar to FIG. 8 but illustrating the device in one possible partially folded state and being ready to receive a CD thereupon.
Figure 10:
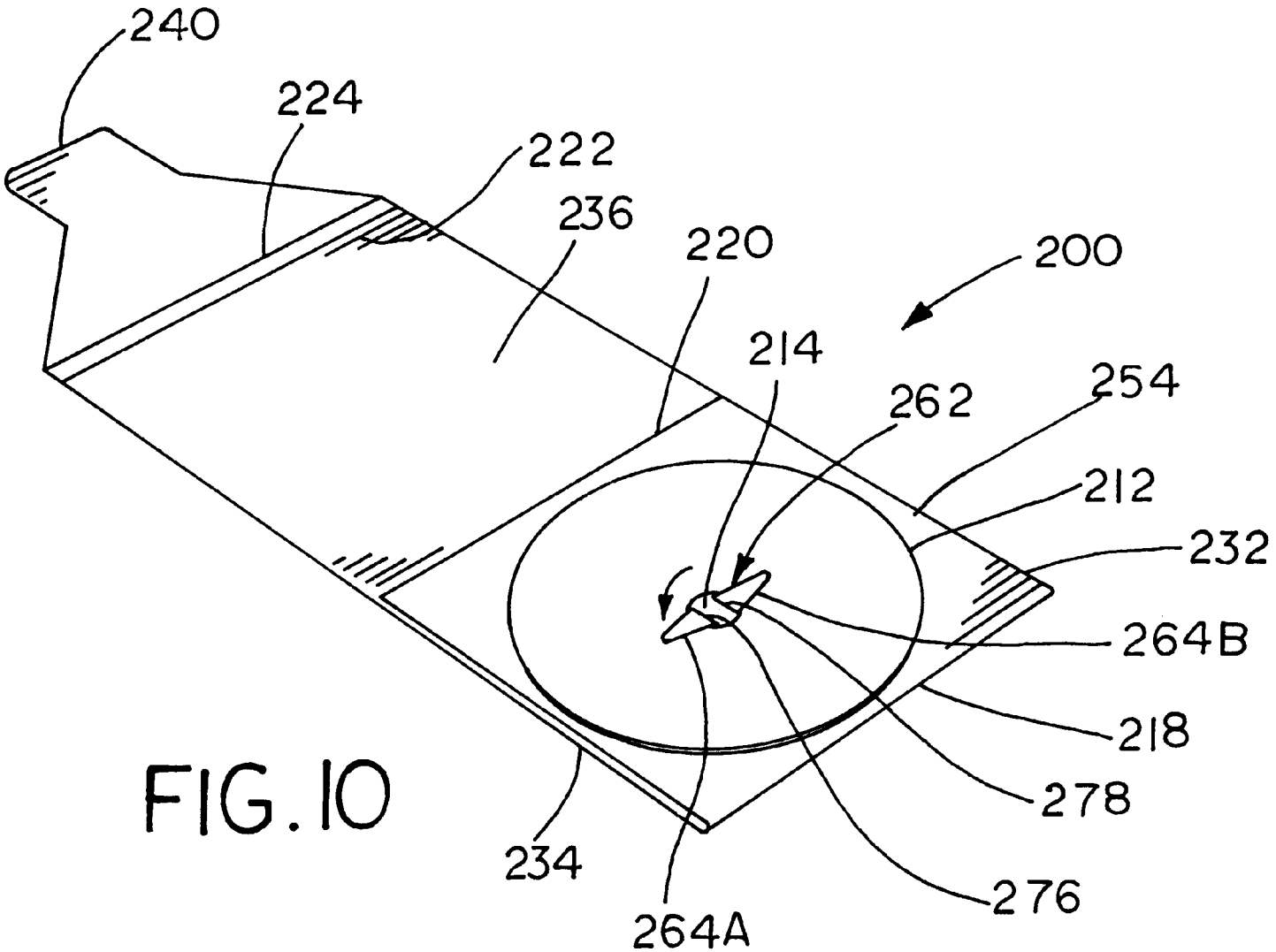
FIG. 10 is a perspective view similar to FIG. 9 but showing a single CD secured to the device.
Figure 12:
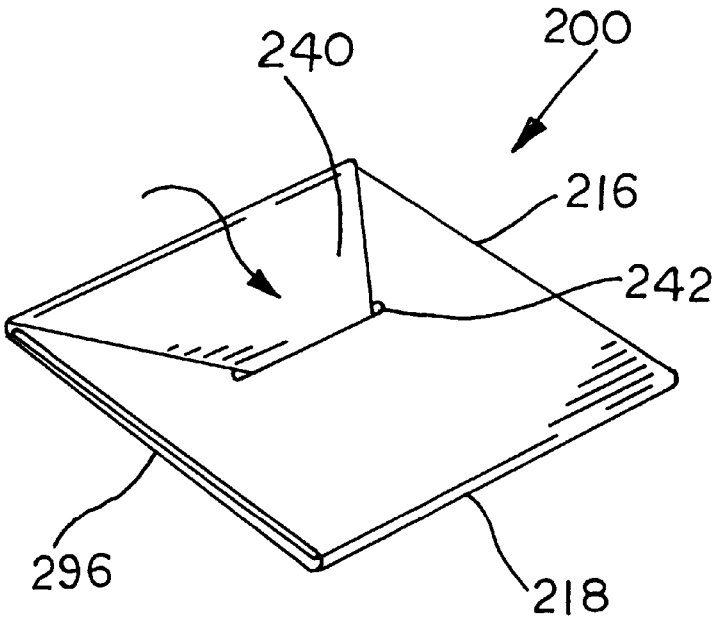
FIGS. 11 and 12 are perspective views illustrating one possible sequence for folding the sections of the device illustrated in FIGS. 8, 9 and 10 so as to create a CD carrier or mailer.
Figure 11:
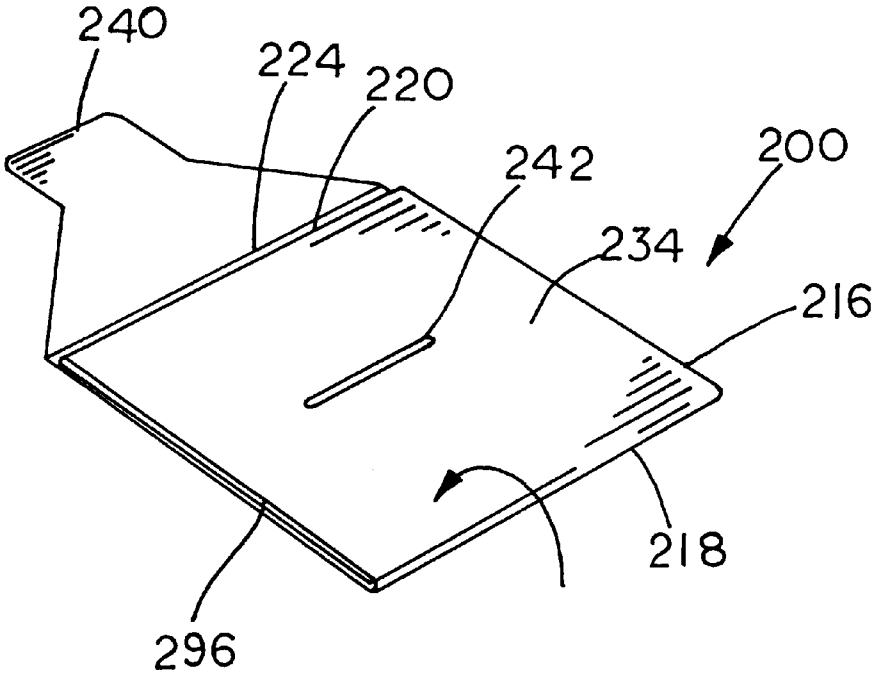

The panel 234 may be folded along the fold line 218 to the position of FIG. 9 and secured in that position using a pair of adhesive strips 210. When the panel 232 is positioned as shown in FIG. 9, a section 254 is formed. When the section 254 is folded along the fold line 220, an enclosure 296 is defined. The tab 240 may be inserted in the slot 242 to secure the CD carrier 200 in the closed position as shown in FIGS. 11 and 12.

As shown in each of FIGS. 8 and 9, a hub 262 is defined in the panel 232. The hub 262 in the panel 232 is preferably substantially identical to the hub 62 described above with respect to the first embodiment. The hub 262 includes a pair of arms or members 264A and 264B. The member 264A includes an outer portion 266A terminating in a tip 268A. The member 264B includes an outer portion 266B terminating in a tip 268B. A portion of the surrounding panel, in the illustrated case the panel 232, defines a base 270. The members 264A and 264B are each deflectable or foldable along a fold line 272, 274, respectively, from the relatively flat position illustrated in FIG. 8, toward the upright, deflected or first folded position of FIG. 9, and then toward the position of FIG. 10 in order to secure a CD 12 thereon. A cutout 286 is formed adjacent the member 264A, while a cutout 288 is formed adjacent the member 266A. The member 264A is defined in part along a boundary indicated by the lines 288, 290, which lines 288, 290 are preferably score lines defining frangible connections. The member 264B is defined in part along a boundary indicated by the lines 292, 294, which lines 292, 294 are preferably score lines defining frangible connections. The cutouts 286, 288 need not be provided, but will better enable a user (not shown) to grasp the members 264B and 264B in order to manipulate the members as described above. It will be understood that the hub 262 may be similar in all respects to the hub 62 described above with respect to the first embodiment.

Figure 14:
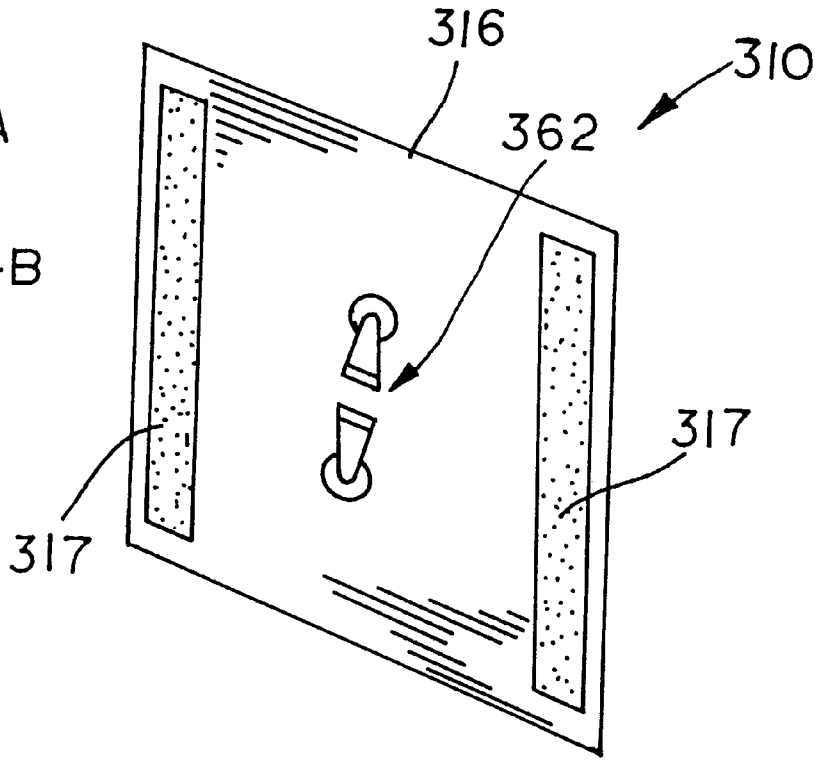
FIG. 14 is a perspective view of the hub device shown in FIG. 13 but taken from the opposite side thereof.
Figure 13:
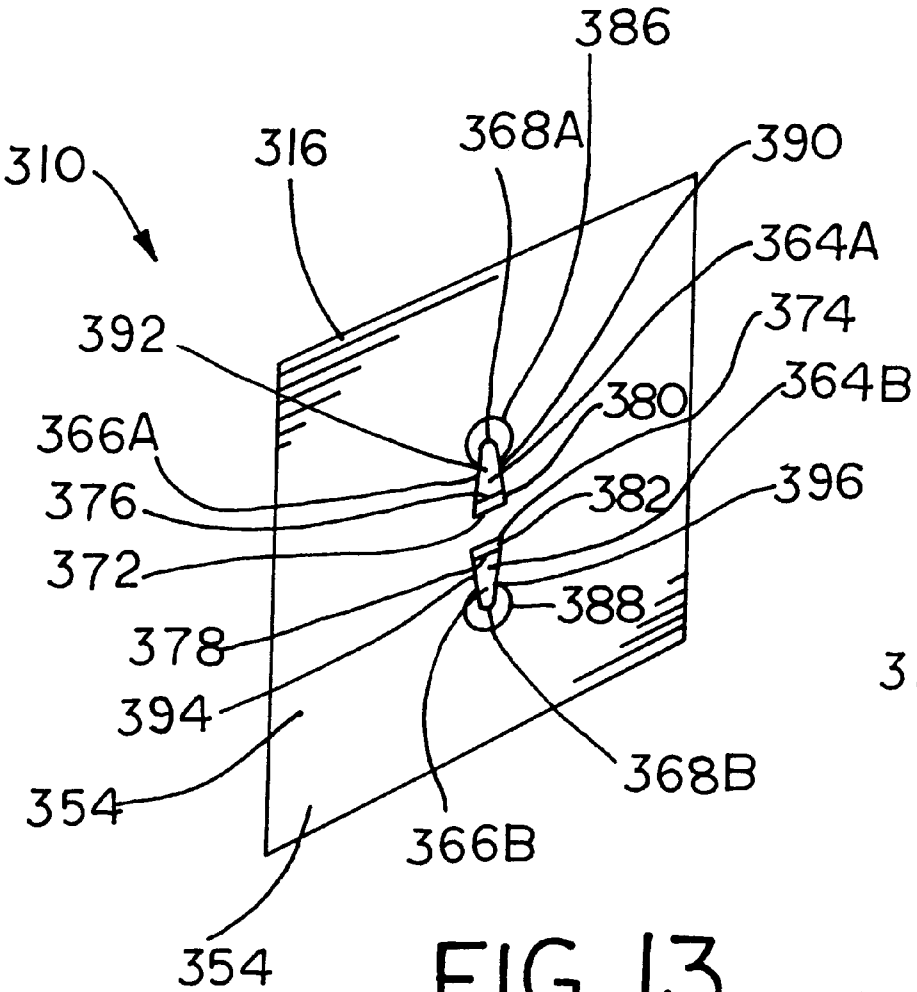
FIG. 13 is a perspective view of a CD carrier or hub constructed in accordance with the teachings of a third embodiment of the present invention and shown in its flat or unfolded state.
Figure 15:
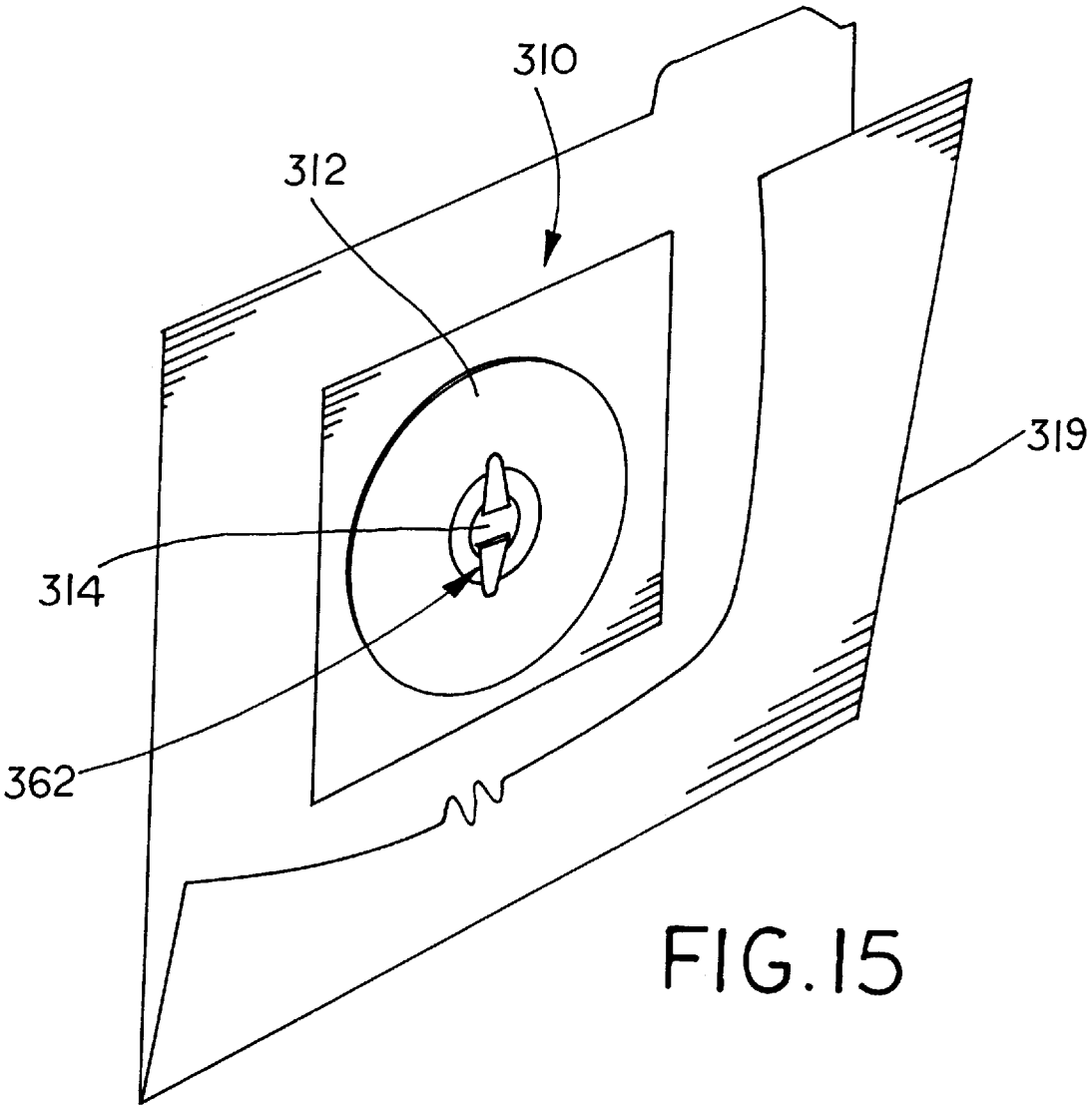
FIG. 15 is a perspective view of the device of FIGS. 13 and 14 shown attached to a surface, such as the surface of a file folder.

Referring now to FIGS. 13–15, a CD carrier constructed in accordance with the teachings of a third preferred embodiment of the present invention is generally referred to by the reference numeral 310. The CD carrier 310 may be used to carry a compact disc 312 (hereinafter "CD") of the type described above in conjunction with the embodiment of FIGS. 1–7. The CD carrier 310 is constructed of a paper or paperboard blank 316. The blank 316 will include at least one adhesive portion 317, to thereby permit the CD carrier 310 to be secured to a planar surface, such as the planar surface of a file folder 319 of the type shown in FIG. 15. The CD carrier 310 includes a hub 362 defined in the blank 316. The hub 362 includes a pair of arms or members 364A and 364B. The member 364A includes an outer portion 366A terminating in a tip 368A. The member 364B includes an outer portion 366B terminating in a tip 368B. A portion of the surrounding blank 316 defines a base 370. The members 364A and 364B are each deflectable or foldable along a fold line 372, 374, respectively, from relatively flat position (similar to that illustrated in FIGS. 2 and 2B), toward the upright, deflected or first folded position (similar to that illustrated in FIG. 2A). Subsequent to the placement of a CD 312 adjacent the section 354, the members 364A and 364B may be folded down along the fold lines 376, 378 to secure the CD 312 to the CD carrier 310 as shown in FIG. 15.

A cutout 386 is formed adjacent the member 364A, while a cutout 388 is formed adjacent the member 366A. The member 364A is defined in part along a boundary indicated by the lines 388, 390, which lines 388, 390 are preferably score lines defining frangible connections. The member 364B is defined in part along a boundary indicated by the lines 392, 394, which lines 392, 394 are preferably score lines defining frangible connections. The cutouts 386, 388 need not be provided, but will better enable a user (not shown) to grasp the members 364B and 364B in order to manipulate the members as described above. It will be understood that the hub 362 may be similar in all respects to the hub 62 described above with respect to the first embodiment.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the claims is reserved.

What is claimed:

1. A device for carrying a compact disc, the device comprising:

a compact disc having a central aperture, the central aperture having a diameter, the aperture further defining an inner edge;

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned generally perpendicular to the plane of the one section so as to extend through the compact disc aperture, and a second folded position in which the outer portion is foldable along a second fold line, the pair of members being spaced to permit the outer portion of both of the members to be inserted through the compact disc aperture simultaneously when the outer portion of both of the members is in the first folded position, the second fold line being spaced away from the first fold line by a distance generally equivalent to the thickness of the compact disc, each of the members having a root section measuring about 75% of the diameter of the compact disc aperture so as to engage the inner edge of the compact disc aperture exclusively at only two points, each of the members engaging the inner edge of the compact disc aperture at the same only two points when in the first folded position and when in the second folded position;

whereby upon shifting the members to the first folded position a compact disc may be placed adjacent the one section and upon shifting the members to the second folded position and folding the sections to the closed position a compact disc may be secured in the enclosure.

2. The device of claim 1, wherein each member is sized to engage a portion of the compact disc aperture so that the second fold line is formed in part upon folding each member from the first folded position toward the second folded position after placement of the compact disc adjacent the one section.

3. The device of claim 1, wherein a second one of the sections includes a protruding tab, and another one of the sections includes a slot positioned for engagement by the tab.

4. The device of claim 1, including means carried by at least one of the sections for maintaining the sections in the closed position.

5. The device of claim 1, wherein a second one of the sections includes a protruding tab, the tab including securement means for securing the tab to another one of the sections to thereby maintain the sections in the closed position.

6. A device for carrying a compact disc having a central aperture, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned to extend through the compact disc aperture, and a second folded position in which the outer portion is foldable along a second fold line, the second fold line being spaced away from the first fold line by a distance generally equivalent to the thickness of the compact disc;

the compact disc aperture having a diameter measuring about 1.5 centimeters and having a circular inner edge, and wherein each member includes a root section measuring about 1.1 centimeters to engage the inner edge;

whereby upon shifting the members to the first folded position a compact disc may be placed adjacent the one section and upon shifting the members to the second folded position and folding the sections to the closed position a compact disc may be secured in the enclosure.

7. A device for carrying a compact disc having a central aperture, the compact disc aperture having a diameter measuring about 1.5 centimeters and having a circular inner edge, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member having a root section measuring about seventy five percent of the diameter of the compact disc aperture, each member including an outer portion sized to extend through the compact disc aperture, each member being shiftable between an unfolded position in which the member is disposed in the plane of the one section, a first folded position in which the member outer portion is folded along a first fold line and positioned generally perpendicular to the plane of the one section so as to extend through the compact disc aperture, and a second folded position in which the outer portion is foldable along a second fold line, the pair of members being spaced to permit the outer portion of both of the members to be inserted through the compact disc aperture simultaneously when the outer portion of both of the members is in the first folded position, the second fold line being spaced away from the first fold line by a distance generally equivalent to the thickness of the compact disc;

whereby upon shifting the members to the first folded position a compact disc may be placed adjacent the one section and upon shifting the members to the second folded position and folding the sections to the closed position a compact disc may be secured in the enclosure.

8. A device for carrying a compact disc having a central aperture, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure;

a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned generally perpendicular to the plane of the one section so as to extend through the compact disc aperture, and a second folded position in which the outer portion is foldable along a second fold line, the pair of members being spaced to permit the outer portion of both of the members to be inserted through the compact disc aperture simultaneously when the outer portion of both of the members is in the first folded position, the second fold line being spaced away from the first fold line by a distance generally equivalent to the thickness of the compact disc; and wherein each member is defined in part by a score line formed in the one section and generally circumscribing the outer portion, each score line defining a frangible connection;

whereby upon shifting the members to the first folded position a compact disc may be placed adjacent the one section and upon shifting the members to the second folded position and folding the sections to the closed position a compact disc may be secured in the enclosure.

9. A device for carrying a compact disc having a central aperture, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned generally perpendicular to the plane of the one section so as to extend through the compact disc aperture, and a second folded position in which the outer portion is foldable along a second fold line, the pair of members being spaced to permit the outer portion of both of the members to be inserted through the compact disc aperture simultaneously when the outer portion of both of the members is in the first folded position, the second fold line being spaced away from the first fold line by a distance generally equivalent to the thickness of the compact disc; and a tip defined on each member, and wherein the one section includes an aperture formed adjacent each tip, the aperture being sized to permit grasping of the member tip by a user;

whereby upon shifting the members to the first folded position a compact disc may be placed adjacent the one section and upon shifting the members to the second folded position and folding the sections to the closed position a compact disc may be secured in the enclosure.

10. A hub device for securing a compact disc having a central aperture to a generally planar surface, the hub device comprising:

a paperboard section having a plurality of score lines formed therein, the score lines defining a pair of members and a generally planar base, each of the members including a root section, each of the members tapering from the root section toward an outer portion, the outer portion sized to extend through the compact disc aperture, each member being shiftable between an unfolded position in which the member is disposed in the plane of the base, a first deflected position in which the member outer portion is deflected along a first line and positioned generally perpendicular to the plane of the base so as to extend through the compact disc aperture, and a second deflected position in which the outer portion is deflected along a second line, the second line being spaced away from the first line by a distance generally equivalent to the thickness of the compact disc, the members being adapted to secure the compact disc against movement when the members are in the second deflected position, the members being disposed on the planar base so as to extend through the compact disc aperture when both of the members are disposed in the first deflected position; and means carried by the base for securing the section to the planar surface.

11. The hub device of claim 10, the compact disc aperture having a diameter of about 1.5 centimeters, and wherein the root section of each member measures about 1.1 centimeters to thereby engage an inner portion of the compact disc aperture at two discrete points so that the second line is formed in part upon shifting each member from the first deflected position toward the second deflected position after placement of the compact disc adjacent the base.

12. A hub device for securing a compact disc having a central aperture to a generally planar surface, the hub device comprising:

a paperboard section having a plurality of score lines formed therein, the score lines defining a pair of members and a generally planar base, each of the members including an outer portion sized to extend through the compact disc aperture, each member being shiftable between an unfolded position in which the member is disposed in the plane of the base, a first deflected position in which the member outer portion is deflected along a first line and positioned to extend through the compact disc aperture, and a second deflected position in which the outer portion is deflected along a second line, the second line being spaced away from the first line by a distance generally equivalent to the thickness of the compact disc, the members being adapted to secure the compact disc against movement when the members are in the second deflected position, and wherein the compact disc aperture includes a circular inner edge and a diameter measuring about 1.5 centimeters, and wherein the root section of each member measures about 1.1 centimeters so as to engage the inner edge; and means carried by the base for securing the section to the planar surface.

13. A device for carrying a compact disc having a central aperture, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned to extend through the compact disc aperture, and a second folded position in which the outer portion is foldable along a second fold line, the second fold line being spaced away from the first fold line by a distance generally equivalent to the thickness of the compact disc, and wherein each member is defined in part by a score line formed in the section and generally circumscribing the outer portion of each member, each score line defining a frangible connection;

whereby upon shifting the members to the first folded position a compact disc may be placed adjacent the one section and upon shifting the members to the second folded position and folding the sections to the closed position a compact disc may be secured in the enclosure.

14. A device for carrying a compact disc having a central aperture, the device comprising:

a blank formed from a single piece of paper board stock, the blank including a generally rectangular portion having a plurality of fold lines dividing the blank into a plurality of sections, at least one of the sections being foldable along a fold line to a closed position in which the one section forms with an adjacent section an enclosure; and a hub formed in the one section, the hub including a pair of members, each member including an outer portion sized to extend through the compact disc aperture, each member being shiftable between an unfolded position in which the member is disposed in the plane of the one section, a first folded position in which the member outer portion is folded along a first fold line and positioned to extend through the compact disc aperture, and a second folded position in which the outer portion is foldable along a second fold line, the second fold line being spaced away from the first fold line by a distance generally equivalent to the thickness of the compact disc, and wherein each member includes a tip, and wherein the base includes an aperture formed adjacent each tip, the aperture being sized to permit grasping of the member tip by a user;

whereby upon shifting the members to the first folded position a compact disc may be placed adjacent the one section and upon shifting the members to the second folded position and folding the sections to the closed position a compact disc may be secured in the enclosure.

15. A hub device for securing a compact disc having a central aperture to a generally planar surface, the hub device comprising:

a paperboard section having a plurality of score lines formed therein, the score lines defining in part a pair of members and a generally planar base, each of the members including an outer portion sized to extend through the compact disc aperture, each member being foldable between an unfolded position in which the member is disposed in the plane of the base, a first folded position in which the member outer portion is deflected along a first fold line and positioned to extend through the compact disc aperture, and a second folded position in which the outer portion is folded along a second fold line, the second fold line being spaced away from the first fold line by a distance generally equivalent to the thickness of the compact disc, each of the members being adapted to engage the compact disc aperture at only two discrete points to thereby secure the compact disc against movement when the members are in the second deflected position;

each of the pair of members including a root section, the outer portion of each of the pair of members tapering from the root section toward a tip;

an opening formed on the base adjacent each of the pair of members; and means carried by the base for securing the section to the planar surface.

16. A method of forming a compact disc carrier, comprising the steps of:

providing a compact disc having a central aperture, the central aperture having a diameter of about 1.5 centimeters and having a circular inner edge;

forming a paperboard blank having a plurality of fold lines dividing the blank into a plurality of sections;

forming in at least one of the sections a hub, the hub having a pair of deflectable members foldable to a first position in which the members are positioned to receive the compact disc, and a second position in which the members are positioned to retain the compact disc adjacent the one section;

providing a root section on each of the members, each of the root sections sized to engage the inner edge of the compact disc at only two discrete points, each of the members being generally tapered from the root section toward a tip;

positioning the compact disc on the hub with the members in the first position and folding the members to the second position;

forming an enclosure by folding the one section along a fold line to a folded position disposed parallel to an adjacent section; and securing the sections in the folded position.

17. The method of claim 16, including the step of forming the deflectable members by creating score lines in the one section.

18. A method of forming a compact disc carrier, comprising the steps of:

forming a paperboard blank having a plurality of fold lines dividing the blank into a plurality of sections;

forming in at least one of the sections a hub, the hub having a pair of deflectable members foldable to a first position in which the members are positioned to receive the compact disc, and a second position in which the members are positioned to retain the compact disc adjacent the one section;

forming a first fold line on each of the deflectable members, each deflectable member being folded to its first position along the first fold line;

forming a second fold line on each of the deflectable members, each deflectable member being folded to its second position along the second fold line;

forming an enclosure by folding the one section along a fold line to a folded position disposed parallel to an adjacent section; and securing the sections in the folded position.

19. The method of claim 18, wherein the second fold line is formed by placing a compact disc adjacent the one section with the deflectable members in their first position, and folding each deflectable member to its second position, whereby the second fold line in each deflectable member is formed at a location spaced away from the first fold line by a distance generally equivalent to a thickness of the compact disc.

* * * * *